United States Patent [19]

Durtschi

[11] Patent Number: 4,627,329

[45] Date of Patent: Dec. 9, 1986

[54] POWER DRIVE UNIT AND CONTROL SYSTEM THEREFOR

[75] Inventor: William G. Durtschi, Rockford, Ill.

[73] Assignee: Sundstrand Corporation, Rockford, Ill.

[21] Appl. No.: 633,211

[22] Filed: Jul. 19, 1984

[51] Int. Cl.[4] ..... F01B 3/10; F01B 13/04

[52] U.S. Cl. ..... 91/506; 60/911

[58] Field of Search ..... 417/222; 91/506, 505, 91/387; 60/911

[56] References Cited

U.S. PATENT DOCUMENTS

| | | | |
|---|---|---|---|
| 3,429,225 | 2/1969 | Keyworth | 91/506 |
| 3,750,532 | 8/1973 | Kubilos | 91/387 |
| 3,812,765 | 5/1974 | Himmler | 91/387 |
| 3,817,150 | 6/1974 | Cox | 91/387 |
| 4,248,137 | 2/1981 | Caruso | 91/506 |
| 4,466,337 | 4/1984 | Eiler | 91/506 |
| 4,487,109 | 12/1984 | Burandt | 417/222 |

*Primary Examiner*—William L. Freeh

*Attorney, Agent, or Firm*—Wood, Dalton, Phillips Mason & Rowe

[57] ABSTRACT

This invention relates to an energy efficient variable displacement motor-driven power drive unit using a multi-variable feedback control system to control system output position and speed. More particularly, a variable displacement hydraulic motor connected to drive a load has a variable-position wobbler, with the position controlled by electro-hydraulic servo means including an electrically-operable servo valve which receives a control signal from signal summing means which has summed feedback signals representing speed and position of a load with a torque signal representative of wobbler position. The latter signal is mechanically inputted to the servo valve by means of a mechanical connection including a link connected to the wobbler and a spring interconnecting the link to the servo valve and with the link carrying a servo piston movable in a servo cylinder associated with the servo valve.

2 Claims, 2 Drawing Figures

POWER DRIVE UNIT AND CONTROL SYSTEM THEREFOR

DESCRIPTION

1. Technical Field

This invention relates to an energy efficient power drive unit utilizing a variable displacement hydraulic motor and a control system therefor which has an improved multi-variable feedback control to control output position and speed of the power drive unit.

2. Background Art

Many aircraft utilize hydraulic power for actuation of a component, such as a flap or other flight control surface. The hydraulic power is normally provided by a power drive unit and with weight being an important consideration, it is important to have the power drive unit as light and efficient as possible.

A number of developments in providing a power drive unit with weight reduction and improved efficiency have been made by the assignee of this application. These include the developments shown in the Flippo U.S. Pat. No. 4,191,094 and Aldrich U.S. Pat. No. 4,210,066. The Flippo and Aldrich patents disclose power drive units for actuation of a component. In Flippo, the power drive unit has a bi-directional hydraulic motor having a variably positionable wobbler for controlling displacement of the motor. Flippo utilizes hydraulic circuitry for positioning the variable displacement motor at either minimum or maximum displacement or any displacement therebetween and requires reversing hydraulic pressure to the input port of the variable displacement hydraulic motor to reverse the direction of rotation of the motor.

The Aldrich patent has a bi-directional hydraulic motor with a variably positionable wobbler for controlling displacement of the motor. Hydraulic control circuitry provides for fluid flow through the motor in either of two directions and for setting the motor at either minimum or maximum displacement conditions.

The power drive units shown in Flippo and Aldrich do not provide for control of the displacement of the variable displacement motor as a function of the velocity and position of the power drive output nor a power drive unit wherein a reversal in the direction of operation of the motor can be accomplished without reversal of hydraulic flow to the ports of the motor.

A further development of the assignee is shown in a Burandt and Markunas application, Ser. No. 363,701, filed Mar. 30, 1982, now U.S. Pat. No. 4,487,109. The improvements in the power drive unit disclosed therein over the power drive units shown in the Flippo and Aldrich patents are set forth therein in detail. The Burandt and Markunas application discloses a power drive unit having a wobbler controlled variable displacement hydraulic motor and an electrohydraulic control system associated therewith which causes the displacement of the hydraulic motor to match a load to be driven by the power drive unit output shaft coupled to the motor.

The Burandt and Markunas application control system has an electro-hydraulic servo valve with a controlled movable valve member which is responsively coupled to the wobbler to cause the wobbler to move in response to a control signal derived from a signal summing network which receives an input command signal and feedback signals. The wobbler has a wobbler position transducer unit coupled thereto which is electrically coupled to the electro-hydraulic servo valve via the signal summing network. A speed-responsive transducer unit is coupled to the power drive unit output shaft and is electrically coupled via the signal summing network to the electro-hydraulic servo valve. An output position transducer unit is coupled to the power drive unit output shaft and is electrically coupled via the signal summing network to the electro-hydraulic servo valve. The signal summing network outputs a control signal resulting from a summing of the input command signal and the outputs of the wobbler position transducer unit, the speed-responsive transducer unit and the output position transducer unit.

The control system disclosed in the Burandt and Markunas application results in hydraulic motor displacement matching the load as a combined function of the input command signal, the actual wobbler position, and the velocity and position of the power drive unit output shaft which is representative of the velocity and position of a component connected thereto.

A system as disclosed in the Burandt and Markunas application wherein all of the transducer units deliver electrical signals to a signal summing network would normally require, in an aircraft installation, that the signal paths be duplexed, triplexed, and, possibly, even quadruplexed, for complete reliability. This leads to a large number of feedback transducer units and results in a significant increase in cost and weight of the power drive unit. The feedback loop for wobbler position would typically use an LVDT for generating a signal representing wobbler position. This type of device is a particular problem, since it is bulky and expensive and does not lend itself to providing a duplex output signal. The normal solution would be to provide dual LVDT's in a duplex system along with dual signal conditioning.

The invention to be described herein improves on the control system disclosed in the Burandt and Markunas application by use of mechanical structure directing a feedback signal representative of wobbler position directly to the electro-hydraulic servo valve to eliminate the need for a wobbler position transducer unit or a plurality thereof along with the circuitry associated therewith.

DISCLOSURE OF THE INVENTION

The invention disclosed herein relates to a power drive unit having a control system associated therewith, with the power drive unit having a wobbler-controlled variable displacement hydraulic motor, the displacement of which is set to match a load to be driven by a power drive unit output shaft coupled to the motor. The control system, in one particular form, includes an electro-hydraulic servo means operatively associated with said wobbler for control of the position thereof, signal summing means coupled to the servo means and responsive to an input command signal and one or more signals representative of speed and/or position of the power drive unit output shaft for generating a control signal applied to the servo means and with said signal being converted to a torque signal. Summing means at the electro-hydraulic servo valve sums the torque derived from the control signal with a torque signal representing the actual position of the wobbler for controlling wobbler position. More particularly, the actual position of the wobbler is inputted to the electro-hydraulic servo valve by a mechanical connection therebetween including a link operatively connected to the wobbler and a spring connecting the link to a valve member of the servo valve.

A primary feature of the invention is to provide a new and improved energy efficient variable displacement motor-driven power drive unit with a multivariable feedback control system to control system output position and speed and with the wobbler feedback position being mechanically signalled in order to avoid problems inherent in the use of electronic wobbler position feedback transducers and associated circuitry.

An object of the invention is to provide a power drive unit and a control system therefor including servo means for setting the position of the wobbler of a variable displacement hydraulic motor, with the servo means including a servo valve having a valve member and a servo piston connected to the wobbler, and means associated with the servo valve member for summing a first torque representative of one or both of motor shaft position and speed relative to a command signal and a second torque representative of wobbler position.

Still another object of the invention is to provide a power drive unit and an electro-hydraulic control system therefor comprising, a variable displacement hydraulic motor for driving a device and having a movable displacement setting wobbler, servo means for setting the position of the wobbler including an electro-hydraulic servo valve having a valve member, a servo piston connected to the wobbler, and torque summing means associated with the valve member for summing a first torque representative of position and speed of movement of said device relative to a command signal and a second torque representative of wobbler position including a spring mechanically connected between said wobbler and said valve member.

Still another object of the invention is to provide an energy efficient variable displacement motor-driven power drive unit using a multi-variable feedback control system to control system output position and speed wherein a variably-positionable wobbler sets the displacement of the motor as established by servo means including an electro-hydraulic servo valve and with certain feedbacks in the control system being applied to the electro-hydraulic servo valve as a torque and a feedback representing wobbler position being applied as a torque to the electro-hydraulic servo valve through a mechanical connection between the wobbler and the electro-hydraulic servo valve.

A further object of the invention is to provide a variable displacement motor-driven power drive unit as defined in the preceding paragraph wherein the torque applied to the electro-hydraulic servo valve by a mechanical connection from the wobbler includes a link connected to the wobbler and movable in response to movement of the wobbler and which is connected to a valve member of the electro-hydraulic servo valve by means of a spring and with the link including a servo piston movable in a servo cylinder whereby the electro-hydraulic servo valve operates to control the position of the wobbler through movement of the link and the movement of the link provides a feedback directly to the electro-hydraulic servo valve.

An additional object of the invention is to provide an electro-hydraulic control system for a power drive unit having a wobbler-controlled variable displacement hydraulic motor wherein the control system causes the displacement of the hydraulic motor to match a load to be driven by a power drive unit output shaft coupled to said motor, said system comprising: electro-hydraulic servo means operatively associated with said wobbler for control of the position of the wobbler, signal summing means electrically coupled to said electro-hydraulic servo means and responsive to an input command signal and one or more signals representative of speed and/or position of said power drive unit output shaft for generating a control signal applied to said electro-hydraulic servo means, and summing means at the electro-hydraulic servo valve for summing said control signal with the actual position of the wobbler for controlling the position of the wobbler.

A further object of the invention is to provide a power drive unit utilizing a variable displacement motor for driving a device and having servo means associated therewith including a servo valve and a servo cylinder for positioning a movable displacement-setting wobbler of the motor comprising, means for generating a signal indicative of the position of the device, means for generating a signal indicative of the speed of the device, summing means which sums said signals with a command signal and transmits a control signal to said servo valve, and a mechanical connection between said wobbler and said servo valve for mechanically inputting a wobbler position signal into said servo valve which can be summed with said control signal for control of wobbler position.

Still another object of the invention is to provide a power drive unit as defined in the preceding paragraph wherein said servo means is of the electrohydraulic type having an electrically operated servo valve with said summing circuit delivering an electrical control signal to said servo valve and said electrical control signal results in a torque applied to a valve member of the servo valve which is summed with a torque signal derived from the mechanical input of the wobbler position signal which is applied through a spring acting on the valve member of the servo valve.

BEST MODE FOR CARRYING OUT THE INVENTION

Figure 1:
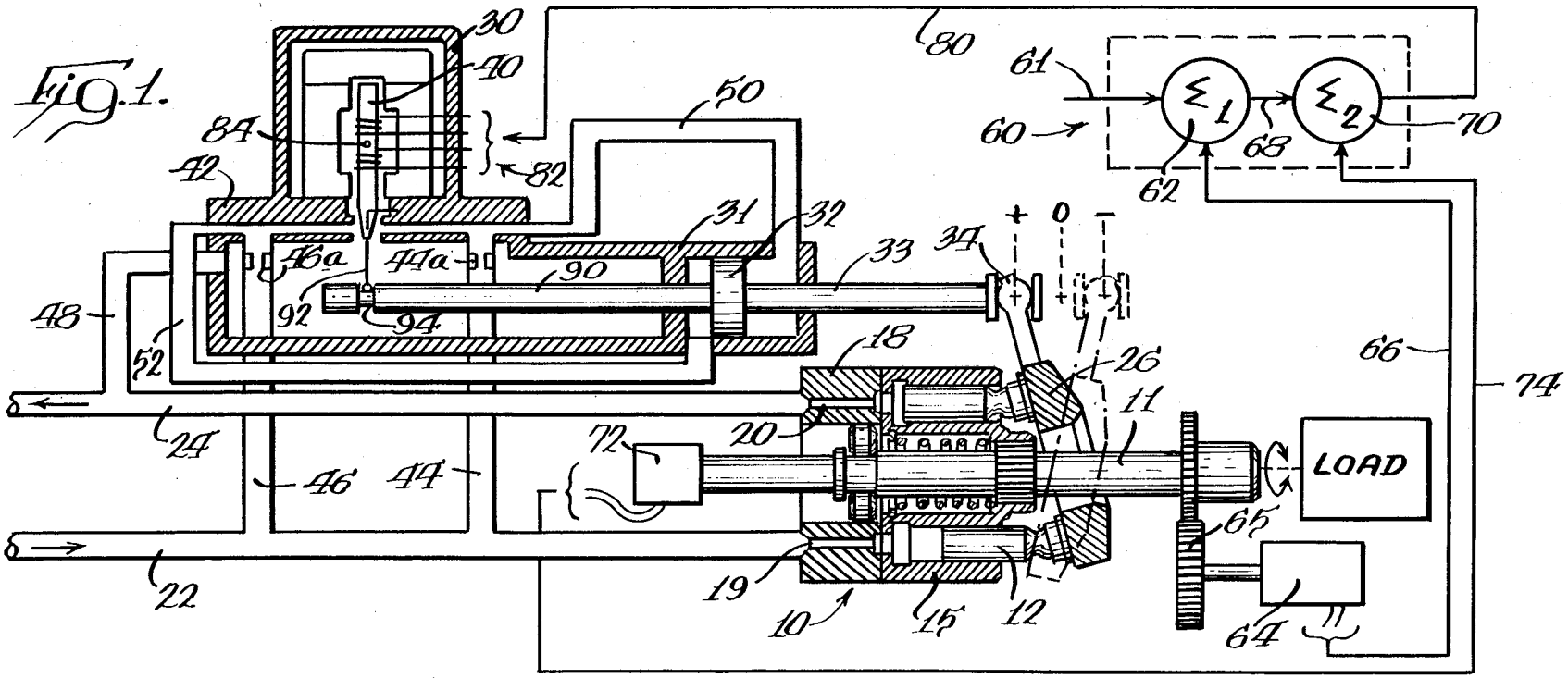
FIG. 1 is a schematic illustration of the power drive unit and the control system therefor, with certain components being shown in central vertical section.

The power drive unit is shown in FIG. 1 and includes a variable displacement hydraulic motor, indicated generally at 10, which drives a power drive unit output shaft 11. The variable displacement motor 10 is shown as an axial piston motor and, as well known in the art, has a series of pistons 12 movable within a series of longitudinal bores in a cylinder block 15 connected to the output shaft 11. A port plate 18 for the motor has a pair of ports 19 and 20 connected to fluid supply and return lines 22 and 24, respectively.

The motor 10 has a movable wobbler 26 with a central zero displacement position and limit positions to either side thereof with one limit displacement position thereof being shown in full line at (+) in FIG. 1 and the other limit position being shown in broken line at (−). With the infinitely variable positioning of the wobbler, the direction of rotation of the output shaft 11 can be reversed and the displacement-setting position of the wobbler determines the stroke of the pistons 12 to have the output of the motor match the potentially bi-directional load experienced by the power drive unit output shaft 11.

The power drive unit output shaft 11 is suitably connected to a device to be driven, such as a flap or other flight control surface of an aircraft, and with the connection being represented by the block identified as LOAD.

The position of the wobbler 26 is under the control of electro-hydraulic servo means including an electrically-operated servo valve, indicated generally at 30, which is associated with a servo cylinder 31 and operates to establish a pressure differential across a servo piston 32 in the servo cylinder 31. A pressure differential positions the control piston and the wobbler 26 by a mechanical connection therebetween by means of a link 33 in the form of a rod which is connected by a ball joint 34 to the wobbler and which carries the servo piston 32. In normal operation, a pressure differential is required to hold the motor in stroke.

The electrically-operable servo valve 30 is well known in the art and has an armature 40 with a lower end thereof functioning as a valve member of the flapper type which can be positioned in response to an electrical control signal to establish either equal or different pressures at opposite sides of the control piston 32. The servo valve has a valve body 42 having connections to the supply line 22 through lines 44 and 46, each of which has an orifice **44*a* and 46*a*, respectively. A line 48 connects the interior of the valve body to the return line 24. Fluid under pressure supplied through lines 44 and 46 passes through the flow-restricting orifices 44*a* and 46*a* to openings at either side of the servo valve member. With the servo valve member positioned equidistant from said openings, there is equal flow through the openings to the interior of the body 42 with the flow passing to the return line 24 through the line 48. When the servo valve member is moved to a position not equidistant from the openings, there is a resulting difference in pressure in the passages adjacent the servo valve member and these differences in pressure are applied to opposite sides of the control piston 32 through the lines 50 and 52**.

In the invention, the servo valve 30 functions as a torque-summing device responsive to torques representing various feedback signals to position the wobbler 26.

A signal-summing means, indicated generally at 60, receives an input command signal delivered via a lead 61 with a first summing circuit 62 summing the input command signal with a power drive unit position signal derived from an output shaft transducer unit 64 associated with the power drive unit output shaft 11 through gearing including a gear 65. The power drive unit position signal is transmitted to the first summing circuit 62 through a lead 66.

The first summing circuit 62 has an output signal representing a velocity command which is delivered by a lead 68 to a second summing circuit 70. The second summing circuit 70 receives a feedback signal representative of the speed of the driven device and measured by rotation of the power drive unit motor output shaft 11. This signal is generated by a transducer unit 72 operatively connected to said shaft and which transmits a signal via the lead 74 to the second summing circuit 70.

Summing means 60 outputs a signal representative of a wobbler position command via a lead 80 to coil wires, indicated generally at 82, which urges the armature 40 to pivot about a pivot point 84 for positioning of the valve member at the lower end thereof. The coils 82, in effect, apply a torque to the armature 40 which is representative of a wobbler position command.

The servo valve 30 also receives a torque signal representative of actual wobbler position. This signal is mechanically delivered to the servo valve by means of the link 33 which has a section 90 thereof extending beyond the servo piston 32 and toward the left as viewed in FIG. 1. A leaf spring 92, fixed to and extending downwardly from, the lower end of the armature 40, loosely engages within a groove 94 in the link section 90 whereby movement of the link from the position shown exerts a torque on the armature 40 through the leaf spring 92.

With this control system, the wobbler 26 will be stationary when the torque signal representing wobbler position command is matched by the feedback torque signal representing wobbler position. When this balancing of torques occurs, there is a positioning of the armature and the valve member at the lower end thereof to establish a pressure differential across the servo piston 32 which positions the wobbler to control motor displacement and, as a result thereof, control the position and speed of the load.

Figure 2:
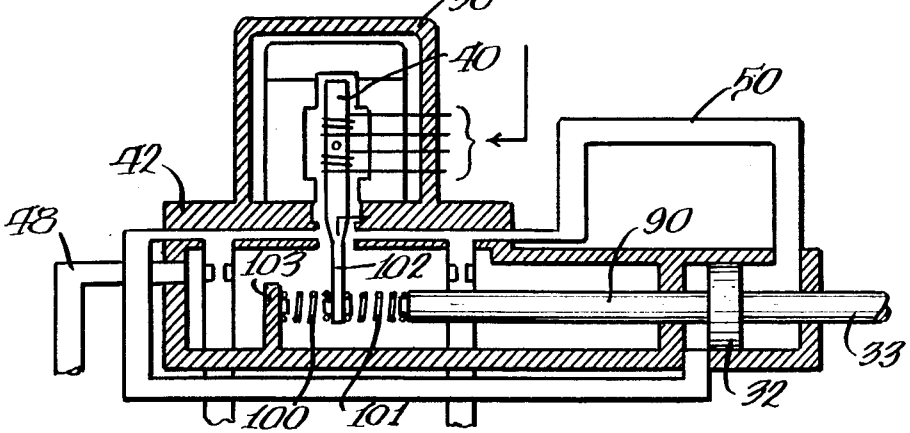
FIG. 2 is a fragmentary view, similar to FIG. 1, illustrating a different embodiment of the invention.

An alternate embodiment of the mechanical feedback of wobbler position to the servo valve is shown in FIG. 2 and wherein the same reference numerals have been applied to structure the same as that shown in FIG. 1. The difference in the embodiment of FIG. 2 is in the form of spring which mechanically connects the link 33 to the servo valve. In the embodiment of FIG. 2, a pair of coil springs 100 and 101 is positioned one at either side of a downward extension 102 of the armature 40. The spring 101 is positioned between the extension 102 and a shortened section 90 of the link 33 and the spring 100 is positioned between the downward extension 102 and an abutment 103 fixed to the body 42. Similarly to the action described in connection with FIG. 1, the axial movement of the link 33 will result in a change in condition of the force of the springs 100 and 101 to exert a torque on the armature 40 for summing with the torque derived from the wobbler position command signal from the signal summing means 60.

The embodiment of FIG. 1 utilizing the leaf spring 92 results in a more simple structure than that shown in FIG. 2. However, the coil spring structure is more easily adjusted to trim out the unit.

From the foregoing description, it is evident that the invention embodies an improved energy efficient variable displacement motor-driven power drive unit using a multi-variable feedback control system to control system output position and speed. The disclosed control is a third order system with three different feedbacks provided to provide a stable control. Two of the feedbacks are electrical through the signal summing means 60 which apply a torque to the servo valve with the servo valve functioning as a torque-summing device to sum the torque derived from the control signal from the signal summing means with a torque derived from the position of the wobbler 26. The feedback representing wobbler position is achieved by mechanical structure and, in a simple manner, merely by association with the conventional servo cylinder and servo piston structure used for positioning of a wobbler of a variable displacement motor. The mechanical feedback structure avoids the use of an electronic feedback of wobbler position which frequently requires duplexing of the feedback with resulting increased weight and expense.

I claim:

1. An electro-hydraulic control system for a power drive unit having a wobbler-controlled variable displacement hydraulic motor wherein the control system causes the displacement of the hydraulic motor to match a load to be driven by a power drive unit output shaft coupled to said motor, said system comprising: electro-hydraulic servo means operatively associated with said wobbler for control of the position of the wobbler including a servo cylinder with a servo piston associated with a reciprocal link connected to said wobbler and an electrically operable valve member for applying a differential pressure to said servo piston, signal summing means electrically coupled to said electro-hydraulic servo means and responsive to an input command signal and one or more signals representative of speed and/or position of said power drive unit output shaft for generating a control signal applied to said electrically operable valve member of said electro-hydraulic servo means, summing means at the electro-hydraulic servo valve for summing said control signal with the actual position of the wobbler for controlling the position of the wobbler by applying a force to said electrically operable valve member representative of wobbler position, and an extension of said link directly connected to said electrically operable valve member for indicating to said summing means the actual position of said wobbler by linear movement thereof.

2. An electro-hydraulic control system for a power drive unit having a wobbler-controlled variable displacement hydraulic motor wherein the control system causes the displacement of the hydraulic motor to match a load to be driven by a power drive unit output shaft coupled to said motor, said wobbler mounted for pivotal movement over a range of arcuate movement such that movement of said wobbler from one end of said range to another results in the reversal of direction of said motor, said control system comprising:

electro-hydraulic servo means hydromechanically coupled to said wobbler for control of the position of the wobbler, said electro-hydraulic servo means including:

a servo cylinder with a reciprocatingly movable servo piston therein, a link mounted for reciprocating movement in said electro-hydraulic servo means, said link having one end integrally connected to said servo piston and another end universally coupled to said wobbler to thereby directly translate said arcuate pivotal movement of said wobbler into linear reciprocating motion of said link and piston, an electrically controlled valve member movable to control a pair of ports, each of which is directly coupled to a source of hydraulic pressure and is hydraulically coupled to an opposite side of said servo piston whereby movement of said valve member between said ports directly produces a pressure differential across said servo piston to thereby control movement of said servo piston and the position of said wobbler, a direct mechanical connection between said servo piston and said valve member for transmitting said linear reciprocating motion of said servo piston and said link, and electro-hydraulic summing means including said valve member, and signal summing means electrically coupled to said electro-hydraulic servo means and responsive to an input command signal and signals representative of speed and position of said power drive unit output shaft for generating a control signal applied to said electro-hydraulic servo means, said electro-hydraulic summing means receives said control signal and is responsive to linear movement of said servo piston and link to thereby cause said valve member to move between said ports and establish a pressure differential across said servo piston which positions said wobbler to control motor displacement and thereby control the position and speed of said load.

* * * * *